US005791584A

United States Patent [19]

Kuroiwa

[11] Patent Number: 5,791,584

[45] Date of Patent: Aug. 11, 1998

[54] TENSION CONTROL UNIT FOR FILAMENTOUS MATERIAL

[76] Inventor: Sachimasa Kuroiwa, 841-4, Azami, Kasakake-machi, Nitta-gun, Gunma-ken, Japan

[21] Appl. No.: 786,486

[22] Filed: Jan. 21, 1997

[30] Foreign Application Priority Data

Jan. 25, 1996 [JP] Japan ..... 8-032977
Oct. 1, 1996 [JP] Japan ..... 8-281517

[51] Int. Cl.[6] ..... B65H 59/18; B65H 59/36; B65H 59/10

[52] U.S. Cl. ..... 242/417.3; 242/419.3; 242/155 M

[58] Field of Search ..... 242/419.3, 419.9, 242/417.3, 147 M, 155 R, 155 BM, 155 M

[56] References Cited

U.S. PATENT DOCUMENTS 2,661,914 12/1953 Thom ..... 242/419.9 X
4,526,329 7/1985 Takeda ..... 242/155 M
4,570,874 2/1986 Takeda ..... 242/155 R X
5,092,534 3/1992 Tanaka ..... 242/155 M
5,429,319 7/1995 Bogucki-Land et al. ..... 242/419.9
5,642,865 7/1997 Fell et al. ..... 242/417.3 X

FOREIGN PATENT DOCUMENTS 2-193871 7/1990 Japan ..... 242/419.9

*Primary Examiner*—Michael Mansen
*Attorney, Agent, or Firm*—Darby & Darby

[57] ABSTRACT

A tension control unit for filamentous material applies a stable tension to filamentous material and is useful to adjust the tension easily at a low cost. The control unit supplies filamentous material from a supply source to a coil winding device while applying a given tension to it via a primary tension pulley to which damping torque is applied and a secondary tension pulley arranged at a swinging end of a tension bar biased in a direction to apply tension. The control unit includes a damping torque generator for applying damping torque to the primary tension pulley in the form of a magnetic disk which rotates integrally with the primary tension pulley and permanent magnets arranged at a given distance at least from a surface of the magnetic disk. The control further includes a stationary torque setting apparatus for setting the damping torque in a steady state by moving the permanent magnets in a radial direction of the magnetic disk.

10 Claims, 6 Drawing Sheets

TENSION CONTROL UNIT FOR FILAMENTOUS MATERIAL

BACKGROUND OF THE INVENTION

1. Field of the Invention

The present invention relates to a tension control unit for winding up filamentous material by applying a given tension to it.

2. Related Background Art

Conventionally, there are known tension control units for winding filamentous material around a coil winding portion (bobbin) by applying a given tension to the filamentous material from a supply source such as the winder disclosed in Japanese Non-examined Patent Publication No. 2-310265 (B65H59/36). In other words, this type of the tension control unit for filamentous material has a primary tension pulley around which the filamentous material is wound and a magnetic disk which rotates integrally with it.

In this case, permanent magnets are mounted at a given short distance (approx. 0.2 mm) from a surface of the magnetic disk. By applying a given magnetic force (magnetic lines of force) to the magnetic disk from the permanent magnets to create attraction, a given damping torque is applied to the magnetic disk. This applies the given damping torque to the primary tension pulley which rotates integrally with the magnetic disk.

By rotating a screw installed in the permanent magnets, the damping torque applied to the primary tension pulley can be adjusted by adjusting the distance between the surface of the magnetic disk and the surface of the permanent magnets in the direction of an axis crossing perpendicularly to each surface. In other words, by changing the distance between the surface of the magnetic disk and the surface of the permanent magnets to change the attraction force applied to the magnetic disk by the permanent magnets, the damping torque of the magnetic disk is adjusted so as to adjust the damping torque applied to the primary tension pulley.

Additionally, there is provided a tension bar for guiding filamentous material around the coil from the primary tension pulley to the coil winding portion of the winder in the tension control unit. It allows an appropriate tension to be applied to a given coil whose filamentous material is wound in a circumferential groove of the primary tension pulley and a given tension (stationary torque) to be applied to the coil whose filamentous material is wound around the filamentous winding bobbin in the coil winding portion to prevent elongation or slack of the coil (filamentous material), so that the filamentous material can be wound in an appropriate state.

Further, if the tension in the coil is increased for some reason while the filamentous material is wound around the bobbin with a given tension applied to the coil (filamentous material), a tension bar swings to adjust the distance between the permanent magnets and the magnetic disk. It weakens the damping torque on the primary tension pulley so as to reduce the increased tension to prevent elongation or slack of the coil.

If the tension applied to the coil is adjusted in this manner, conventionally the distance between the surface of the permanent magnets and the surface of the magnetic disk is adjusted in the direction of the axis perpendicular to each surface so as to adjust the damping torque applied to the primary tension pulley. The distance between the surface of the permanent magnets and the surface of the magnetic disk, however, is extremely short and they are too close to each other. Therefore, when a screw on the permanent magnets is rotated, the magnetic disk is also rotated due to the magnetic force of the permanent magnets.

As a result, the rotation of the magnetic disk is transmitted to the primary tension pulley so as to cause it to rotate, which loosens the filamentous material of the coil wound in the groove on the primary tension pulley and removes it from the groove. Therefore, there has been a problem in that it is required to install a brake or a one-way clutch on the pulley to prevent slack in the coil.

Furthermore, the magnetic force will change greatly with only a small change in the distance between the magnetic disk and the permanent magnets, and therefore the damping torque of the primary tension pulley also changes greatly. Hence, it has been very difficult to adjust the tension applied to the coil.

Accordingly, there has been a problem that, for a fine adjustment of the tension applied to the coil, a stepping motor or the like must be used to adjust the damping torque of the primary tension pulley by controlling the rotation of the motor strictly.

SUMMARY OF THE INVENTION

This invention provides a tension control unit for filamentous material, which allows a stable tension to be applied to the filamentous material and the tension to be adjusted in a simple and low-cost configuration.

In other words, the tension control unit for filamentous material of this invention supplies filamentous material from a supply source to a coil winding portion by applying a given tension to it via a primary tension pulley to which damping torque is applied and arranging a secondary tension pulley at a swinging end of a tension bar which is biased to a tension application side. The unit comprises a magnetic disk which rotates integrally with the primary tension pulley and permanent magnets arranged at a given distance at least from a surface of the magnetic disk. It further includes a damping torque generation means for applying damping torque to the primary tension pulley and a stationary torque setting means for setting the damping torque in a steady state by moving the permanent magnets in a radial direction of the magnetic disk.

In addition, the tension control unit for filamentous material comprises a plurality of magnetic disks which rotate integrally with the primary tension pulley and a plurality of permanent magnets arranged at a given distance from the surfaces of the magnetic disks. The unit includes damping torque generation means for applying damping torque to the primary tension pulley and stationary torque setting means for setting the damping torque in a steady state by moving the permanent magnets in the radial direction of the magnetic disks.

Furthermore, the tension control unit for filamentous material of this invention is characterized by the above permanent magnets each having a ring shape.

In addition, the tension control unit for filamentous material of this invention is characterized by the above permanent magnets each having a plurality of magnetic poles on the circumference.

Still further, the tension control unit for filamentous material of this invention comprises an adjusting shaft arranged to be free to rotate in a body to which the primary tension pulley is installed. Also a spring member is attached to the adjusting shaft with one end fixed to the body and the other end free to move in a lengthwise direction of the adjusting shaft. A damper which rotates is interlocked with the tension bar and is fully shorter than the adjusting shaft, so as to bias the tension bar to the tension application side by means of the spring force of the spring member with a tip of the adjusting shaft brought into contact with the damper.

BRIEF DESCRIPTION OF THE DRAWINGS

The foregoing and other features of the present invention will be readily understood from the following detailed description of the preferred embodiments taken in conjunction with the accompanying drawings wherein.

DETAILED DESCRIPTION OF THE PREFERRED EMBODIMENTS

Figure 1:
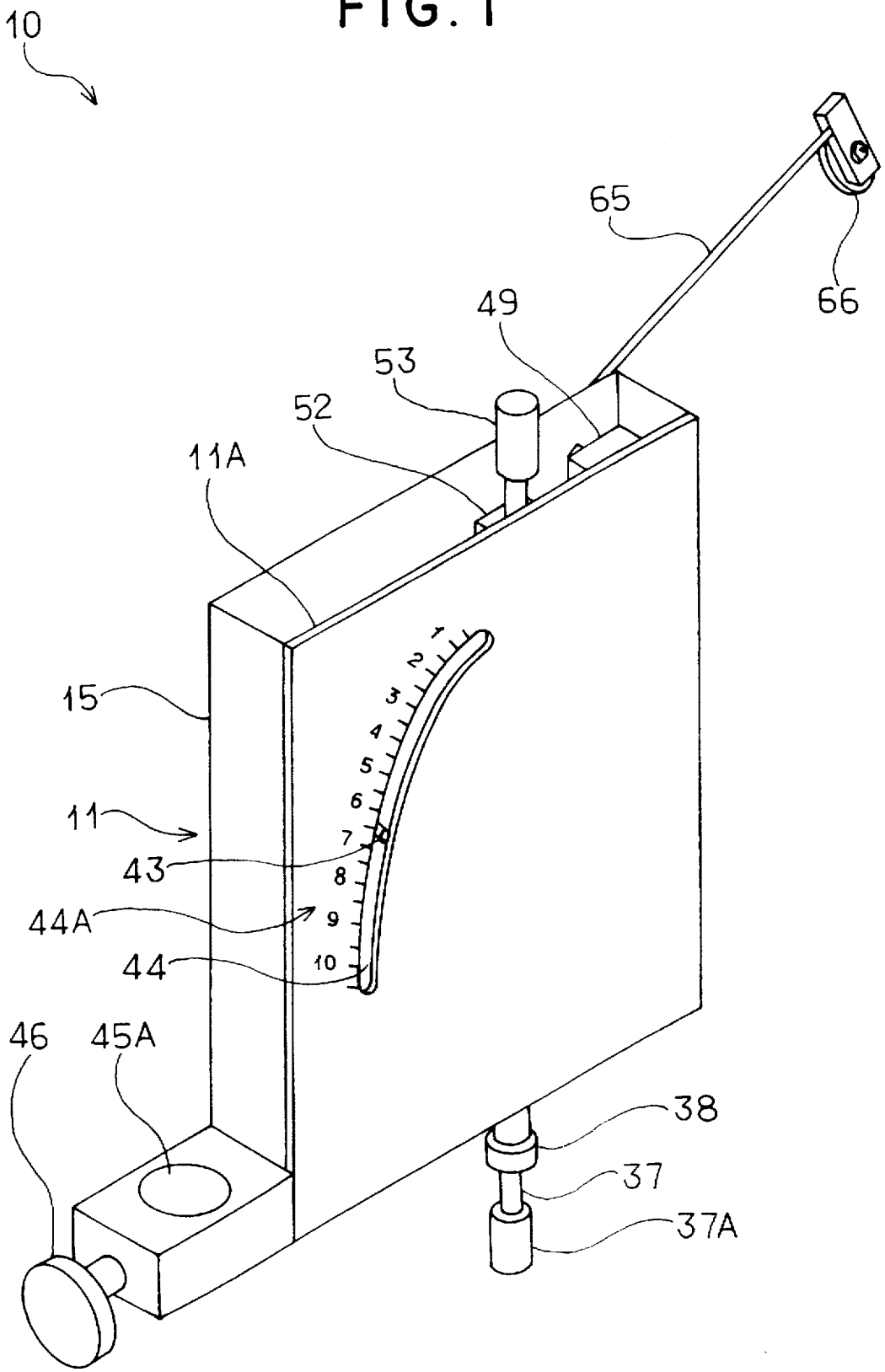
FIG. 1 is a rear side perspective view of a tension control unit for filamentous material of the present invention.

The embodiments of the present invention will be described below by using the accompanying drawings. Referring to FIGS. 1, 2, 3, 4, and 5, there are shown a rear side perspective view of a filamentous material tension control unit 10 of the present invention, a diagram illustrating an internal configuration of the filamentous material tension control unit 10 of the present invention, a cross-sectional view taken on 3—3 of FIG. 2, a cross-sectional view taken on 4—4 of FIG. 2, and a partial configuration diagram of the tension control unit 10 around which filamentous material P is suspended, respectively.

The filamentous material tension control unit 10 of the present invention comprises a body 11, a primary tension pulley 12, a magnetic disk 20, permanent magnets 28, and a torque setting means.

The primary tension pulley 12 is used to prevent defects, such as unevenness of winding, by applying a given tension to the filamentous material P (for example, a coil) to be wound and it is formed of, for example, synthetic resin having a given disk shape. A given groove 12A is arranged on the outer circumferential surface of the primary tension pulley 12 and an O-ring 36 is fixed so as to be mated with the groove 12A. Additionally, a mounting portion 12B protrudes from one side of the primary tension pulley 12 and a magnetic disk 20 described later is mounted on the mounting portion 12B.

On both sides of the shaft core of the primary tension pulley 12, bearings 21 and 21' are arranged concentrically, and the bearings 21 and 21' are mounted on a damping shaft 17, described later, which is free to rotate.

At the mounting portion 12B of the primary tension pulley 12, a magnetic disk 20, a spacer 16, and a further magnetic disk 20' are arranged concentrically in order and are fixed to the mounting portion 12B with a screw 14. As a result, the primary tension pulley 12 and a plurality of magnetic disks 20 and 20' (in this case, two disks) are fixed integrally at given distances.

Figure 5:
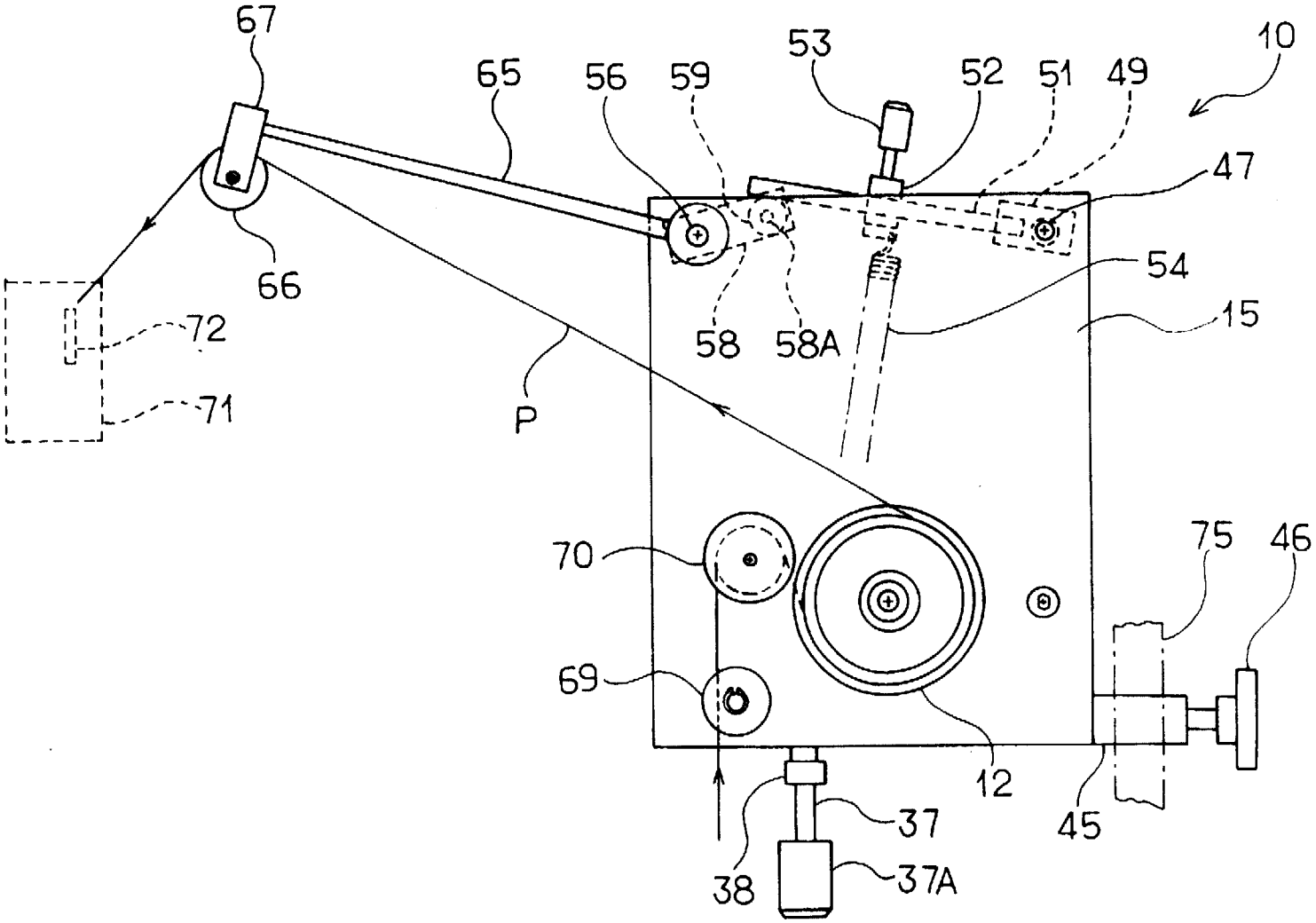
FIG. 5 is a partial configuration diagram of the tension control unit for filamentous material around which the filamentous material is suspended.

The portion on the groove 12A side of the primary tension pulley 12 is arranged outside an outer case 15 described later. Additionally, a filament holding device 69 is arranged protruding from the outer case 15 and the primary tension pulley 12 is arranged between the filament holding device 69 and a bobbin 72 (FIG. 5). The filament holding device 69 is configured so as to give a slight tension to the filamentous material P between the device 69 and the bobbin 72 for winding the filamentous material P. It is also configured so as to rotate the primary tension pulley 12 with the filamentous material P pressed into contact with the O-ring 36 when the filamentous material P is wound around the bobbin 72.

Further, each of the magnetic disks is made of hysteresis material (in this case, for example, an iron plate) which can be easily magnetized. Each magnetic disk is configured so that damping torque is generated due to a magnetic interaction between the rotating magnetic disk and a plurality of permanent magnets 28 (described later) due to attraction from the permanent magnets.

As a result, damping torque is applied to the primary tension pulley 12 which rotates integrally with the magnetic disks 20 and 20'. In other words, the tension pulley 12 is rotated by the filamentous material P which is wound, and each magnetic disk also rotates while being attracted by a plurality of permanent magnets 28, and therefore, the damping torque is applied to the primary tension pulley 12.

Figure 3:
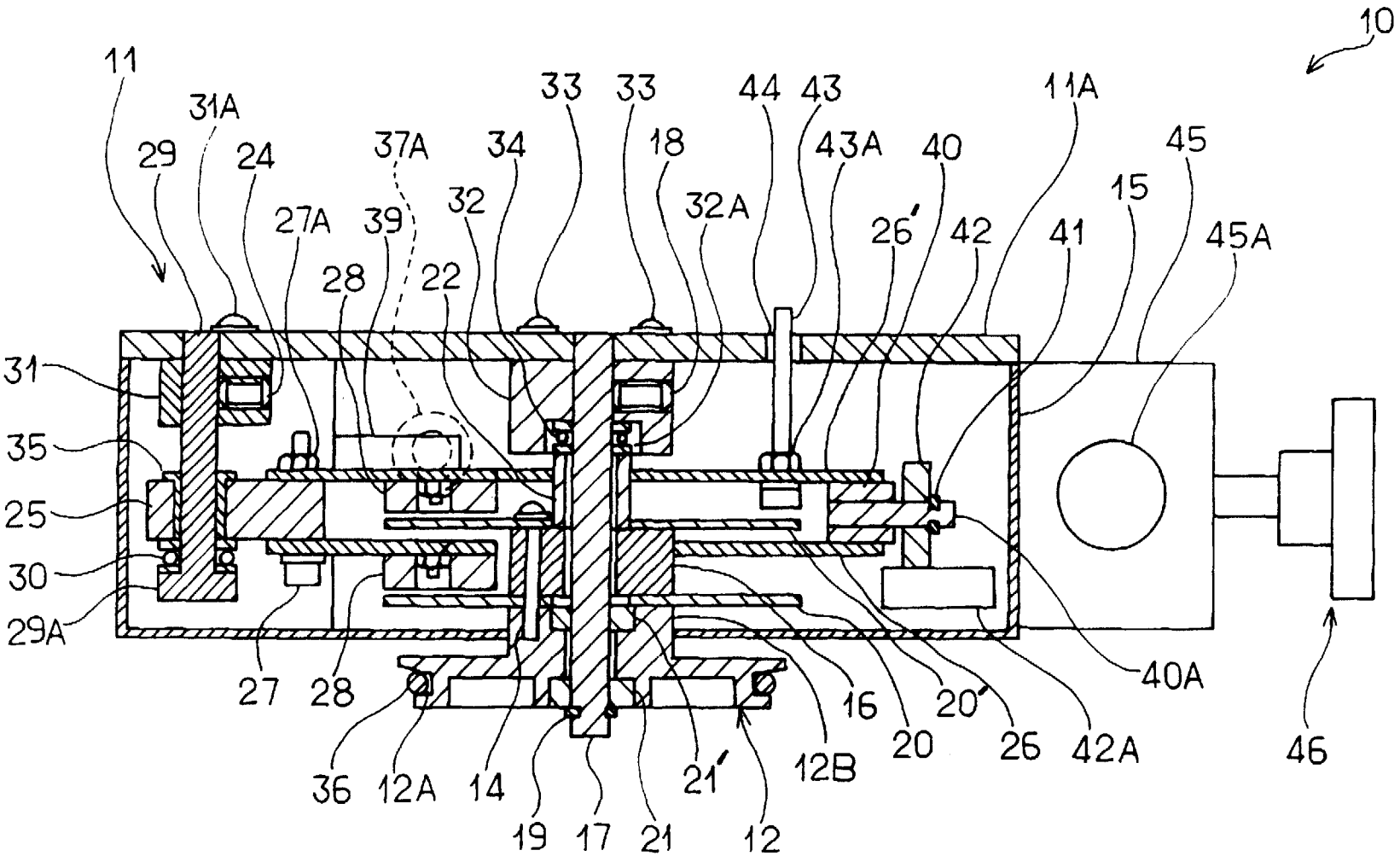
FIG. 3 is a cross-sectional view taken on line 3—3 of FIG. 2.

On the other hand, the body 11 (FIG. 1) comprises a plate 11A having an almost rectangular shape and being made of synthetic resin or metal (in this case, for example, an aluminum plate). In the lower portion of the plate 11A in the outer case 15, a bearing holder 32 is fixed with bolts 33 and a recess portion 32A is formed in an opposite side of the plate 11A of the bearing holder 32 (FIG. 3). At the center of the recess portion 32A of the bearing holder 32, there is provided the damping shaft 17, which has a given length and is fixed to the bearing holder 32 with a bolt 18.

A ball bearing 34, a collar 22, and the primary tension pulley 12 are inserted onto the damping shaft 17 from the side of the magnetic disk and are then fixed with a snap ring 19. The ball bearing 34 is inserted into the damping shaft 17 so that it is almost embedded in the recess portion 32A of the bearing holder 32 and the collar 22 is mated with the magnetic disks 20, 20'. It mounts the primary tension pulley 12 on the damping shaft 17 with the groove 12A of the primary tension pulley 12 located outside the outer case 15 so that it is free to rotate. Reference numeral 70 (FIG. 5) designates a guide pulley.

On the other hand, a bearing holder 31 is fixed with a bolt 31A in the outer case 15 near an end of the plate 11A (FIG. 3). An arm rotating shaft 29 is fixed to the bearing holder 31 with a bolt 24, and a bearing stopper 29A larger than the arm rotating shaft 29 is formed at a tip of the arm rotating shaft 29. A ball bearing 30 is mounted inside the bearing stopper 29A so that it is free to rotate, and an arm holder 35 is mounted on the ball bearing 30.

A moving arm 25 is fixed to the arm holder 35, and at both sides of it, magnet holders 26 and 26', which arranged to extend in a radial direction of the arm rotating shaft 29, are fixed with a bolt 27 and a nut 27A. A plurality of permanent magnets 28 are fixed to both of the magnet holders 26 and 26' with adhesive or the like, and the permanent magnets 28 are fixed opposite to both of the magnetic disks 20 and 20' at a given distance, respectively. In this state, both of the magnet holders 26 and 26' are configured movably from an inner circumference in the radial direction of the magnetic disks 20 and 20' to a remote position, and from the remote position to the inner circumference of the disks.

Figure 2:
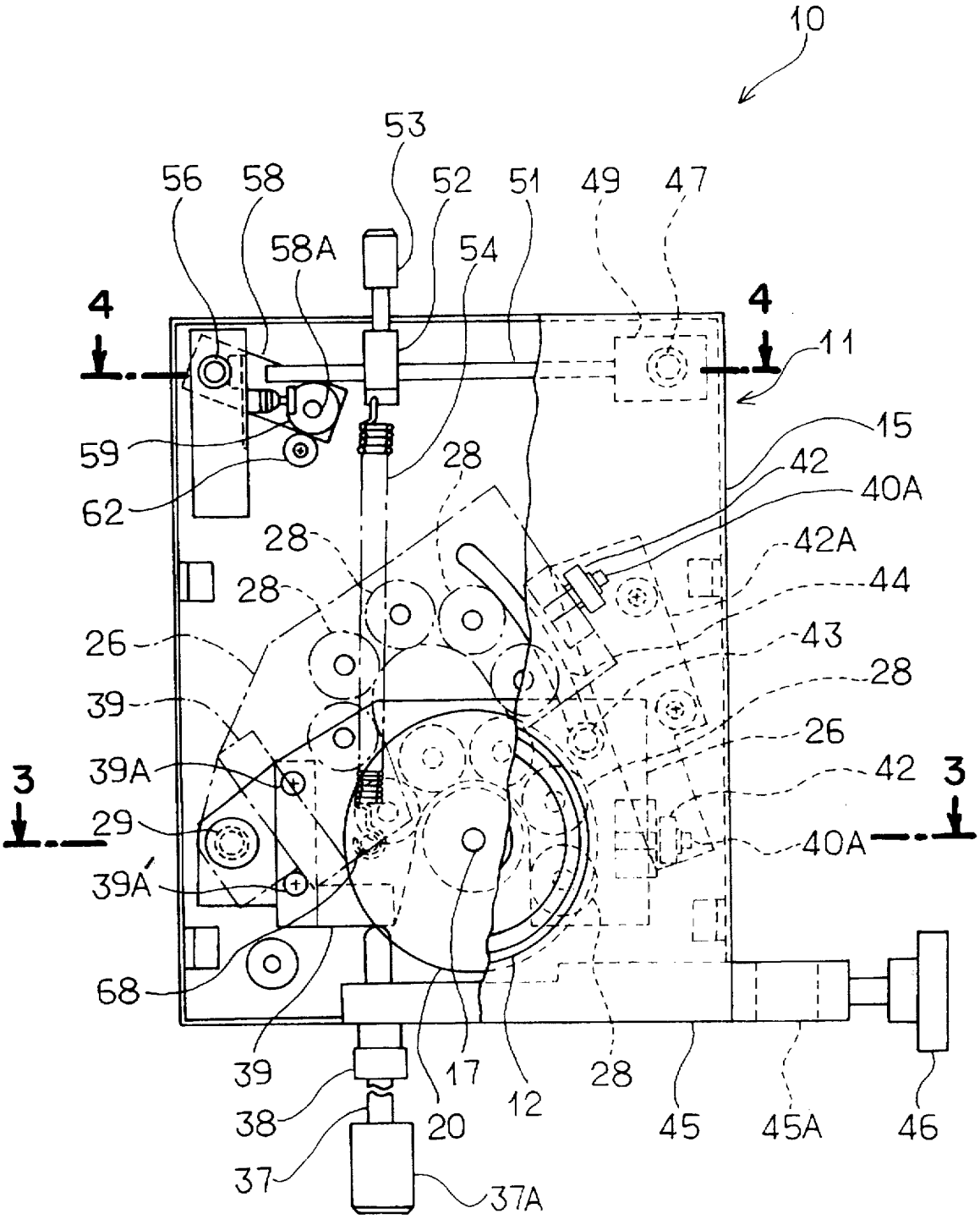
FIG. 2 is a diagram illustrating an internal configuration of the tension control unit for filamentous material of the present invention.

In other words, in one position a plurality of permanent magnets 28 mounted on both the magnet holders are arranged in a half circumference, when viewed in the direction of a removable side panel, viewed with the damping shaft 17 as a center, which shaft is a rotating shaft of the magnetic disks 20 and 20' (FIG. 2). In another position, the outer circumferential edge of the permanent magnets 28 mounted on the magnet holders 26 and 26' is located in almost the same position as an outer circumferential edge of the magnetic disks 20 and 20'. In either position the permanent magnets 28 are mounted at a given lateral distance (approx. 0.2 mm in FIG. 3) from both the magnetic disks 20 and 20', respectively.

A hook-shaped backing plate 39, with which a tip of the adjusting bolt 37 (described later) is in contact, is fixed to the magnet holder in the side of the bearing holder 32 with screws 39A and 39A', and the backing plate 39 is mounted on the side of the arm rotating shaft 29.

At an end of both the magnet holders 26 and 26' mounted on the arm rotating shaft 29, there is fixed a spacer 40 having almost the same thickness as the moving arm 25. The spacer 40 has a supporting shaft 40A protruding from the opposite side of the arm rotating shaft 29 with a supporting bearing 42 fixed to the supporting shaft 40A with a snap ring 41 so that it is free to rotate.

In addition, a supporting plate 42A is attached to the plate 11A and the supporting bearing 42 is in contact with the supporting plate 42A, by which both the magnet holders 26 and 26' are installed in parallel with respect to the magnetic disks 20 and 20.

A position indication pin 43 is fixed to the magnet holder on the side of the bearing holder 32 with a nut 43A, and the position indication pin 43 is fixed near the spacer 40. A long aperture 44 in an arc shape (FIGS. 1 and 2) is provided on the plate 11A and the long aperture 44 is arranged to correspond to the moving range of the position indication pin 43. The position indication pin 43 is set with its tip slightly protruding from the long aperture 44, and graduations 44A (in this case, numbers 0 to 10) are indicated beside the long aperture 44.

The graduations 44A are composed so as to indicate the position of the permanent magnets 28 moving in a radial direction of the magnetic disk. In other words, the position indication pin 43 is provided at an opposite side of the moving arm 25 in the magnetic holders, so that the graduations 44A where the position indication pin 43 is located indicates a measure of the tension applied to the filamentous material P.

Figure 6:
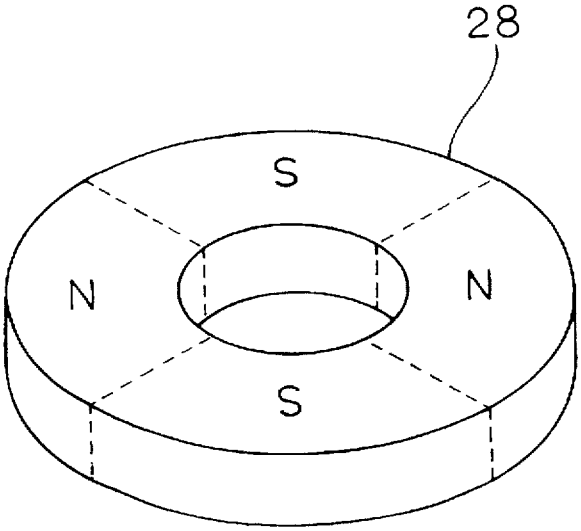
FIG. 6 is a perspective view of permanent magnets.
Figure 7:
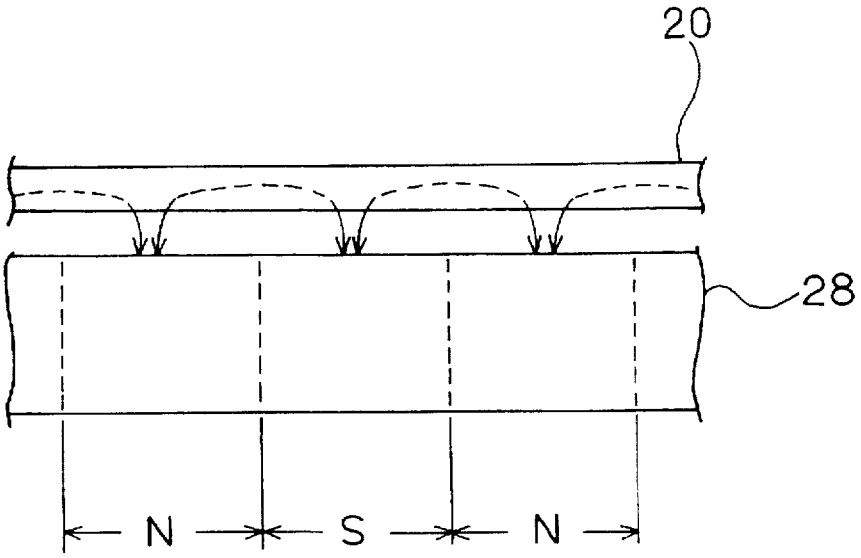
FIG. 7 is a diagram illustrating the flow of a magnetic lines of force between the permanent magnets and the magnetic disks.

Now, referring to FIGS. 6 and 7, the permanent magnets will be described. Each of the permanent magnets 28 has a given ring shape and at least four poles (N, S, N, and S poles) in a circumferential direction. In this case, if hysteresis material (e.g., an iron plate) is arranged at a given distance from a permanent magnet 28 having a plurality of magnetic poles, adjacent different polarity magnetic poles are attracted to each other through the hysteresis material.

In other words, the magnetic forces of respective permanent magnets 28 act as attraction forces between adjacent magnetic poles (indicated by arrows in FIG. 7) passing through the portions of the magnetic disks opposite to the magnets, by which a great magnetic action is obtained. Then, if the magnetic disks 20 and 20' rotate, great damping torque (magnetic action) is generated between a plurality of the permanent magnets 28 and the magnetic disks and this damping torque becomes the damping torque of the primary tension pulley 12.

On the other hand, the torque setting means is used to set a tension applied to the filamentous material P optimally, and comprises a fixed arm 45 (FIG. 2) arranged in the lower portion of the plate 11A and an adjusting bolt 37 having a given length, which bolt is screwed into the fixed arm 45. One end of the adjusting bolt 37 is put into contact with a side of the backing plate 39 fixed to the magnetic holder and an adjusting control 37A is attached to the other end of it.

A nut 38 for fixing the adjusting bolt 37 and a fixing hole 45A are arranged at small distances from the body 11, respectively. A fixing screw 46 and a fixing shaft 75 are used to fix stably the tension control unit 10 for filamentous material near a winder 71 (FIG. 5).

When the center of the magnetic disks is matched with the center of the permanent magnets 28 (the center of the half circumference) mounted on both the magnet holders 26 and 26' in a half-circumferential ring shape (indicated by dashed lines in FIG. 2), the permanent magnets 28 have the largest areas which face the magnetic disks and therefore the greatest damping torque is generated. When the permanent magnets 28 mounted on both the magnet holders 26 and 26' in a half circumference are separated by the greatest distance from the magnetic disks (indicated by alternate long and short dash lines in FIG. 2), the permanent magnets 28 have the smallest areas which face the magnetic disks, and therefore the smallest damping torque is generated.

In these conditions, by rotating the adjusting control 37A, for example, in a clockwise direction, a plurality of the permanent magnets 28 mounted on both the magnet holders 26 and 26' move from the side of the inner circumference of the magnetic disks 20 and 20' toward the outer circumference thereof. As a result, the permanent magnets 28 are further separated from the magnetic disks 20 and 20', and therefore the damping torque applied to the primary tension pulley 12 is weakened.

By rotating the adjusting control 37A in a counterclockwise direction, the permanent magnets 28 move from the side of the outer circumference of the magnetic disks to the inner circumference thereof. As a result, the permanent magnets 28 approach the magnetic disks 20 and 20, and therefore the damping torque applied to the primary tension pulley 12 is increased.

The magnet holders 26 and 26' are biased into contact with the tip of the adjusting bolt 37 and the thus permanent magnets 28 (the magnet holders 26 and 26') are always biased toward the center of the magnetic disks 20 and 20'. In this case, the permanent magnets 28 separated from the magnetic disks 20 and 20' have a weak magnetic attraction and therefore they are attracted in the direction of a stronger magnetic attraction. As a result, by rotating the adjusting bolt 37, both the magnet holders 26 and 26' can move from the outer circumference of the magnetic disks 20 and 20' to the inner circumference thereof or from the inner circumference to the outer circumference.

As described above, the permanent magnets 28 can be moved in the radial direction of the magnetic disks by rotating the adjusting bolt 37, and therefore, it is possible to adjust the strength of the magnetic force applied to both the magnetic disks 20 and 20' by the permanent magnets 28 by degrees. Accordingly, the damping torque generated in the magnetic disks can be finely adjusted and it becomes possible to adjust the damping torque applied to the primary tension pulley 12 finely. Therefore, it becomes possible to adjust finely the tension applied to the filamentous material P, so that the tension of the filamentous material P wound around the bobbin 72 in a steady state can be optimally adjusted.

To change significantly the tension applied based on the filamentous material P to be wound, the adjusting control 37A may be rotated by several turns.

Figure 4:
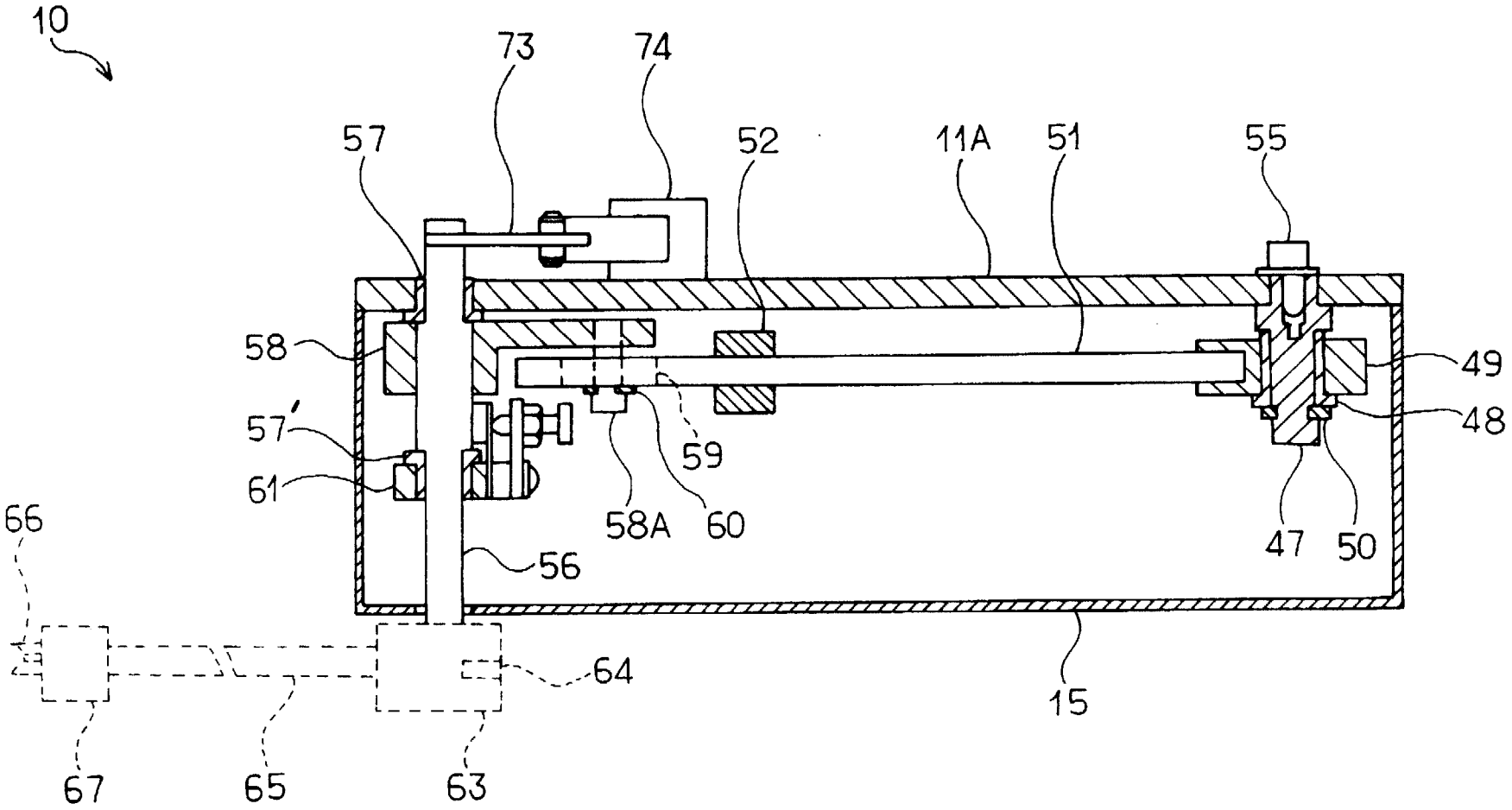
FIG. 4 is a cross-sectional view taken on line 4—4 of FIG. 2.

In the upper right side of the plate 11A, a damper fixing shaft 47 is fixed with a bolt 55, and in the left side, a tension shaft 56 described later is arranged (FIGS. 2, 4 and 5). A damper fixing plate 49 is attached to the damper fixing shaft 47 so as to be free to rotate via a bearing 48 and an adjusting shaft 51 having a given length is attached to the damper fixing plate 49. The adjusting shaft 51 is arranged to extend toward the tension shaft 56 with its tip biased in contact with a damper bearing 59, described later. A reference numeral 50 designates a snap ring.

An adjusting instrument 52 is installed on the adjusting shaft 51 with a fixing screw 53. The adjusting instrument 52 which is installed can move from one end of the adjusting shaft 51 to the other end of it. A coil spring 54, as a spring member, is suspended between the adjusting instrument 52 and a pin 68 fixed to the plate 11A, by which the adjusting shaft 51 is always biased toward the pin 68. A filament breaking detection switch 74 and a switch actuating lever 73 are used to stop operation of the tension control unit 10 when the filamentous material P is broken.

A tension frame 61 (FIG. 4) is fixed to the plate 11A and the tension shaft 56 is installed in a bearing fixed to the tension frame 61 and a bearing 57 installed in the plate 11A so as to be free to rotate. A damper 58 having a given length (about one-fourth of the length of the adjusting shaft 51) is fixed to the tension shaft 56 between both the bearings 57 and 57, and a damper bearing 59 is installed in a damper shaft 58A arranged at a tip of the damper 58 so as to be free to rotate. A snap ring 60 holds the damper bearing 59 and a stopper 62 prevents the damper shaft 58A from lowering further.

The ends of the tension shaft 56 slightly protrude into the plate 11A and the outer case 15, and a stop instrument 63 is fixed to the tension shaft 56 protruding in the side of the outer case 15 with a screw 64. A tension bar 65 of a given length, and having a certain amount of elasticity, is fixed to the stop instrument 63 and the tension bar 65 is installed in the damper shaft 58 at a given angle.

A secondary tension pulley 66 (FIGS. 4 and 5) is installed so as to be free to rotate at the tip of the tension bar 65 with a pulley fixture 67, and when the secondary tension pulley 66 moves vertically, the damper bearing 59 rotates in a vertical direction while being interlocked with the secondary tension pulley 66.

For the above configuration, an explanation will be given below, by giving an example, of the use of the tension control unit 10 for filamentous material.

It is assumed that the tension control unit 10 for filamentous material is fixed to the fixing shaft 75 (FIG. 5) while being arranged near the winder 71. Further, it is assumed that the filamentous material P as shown in FIG. 5 is guided to a winding portion (bobbin 72) of the winder 71 via a filament holding device 69, a guide pulley 70, the primary tension pulley 12 (in this case, that the filamentous material P may be wound by several turns around the primary tension pulley 12), and the secondary tension pulley 66.

In addition, it is assumed that the adjusting instrument 52 is fixed with a fixing screw 53 at a position where the tension bar 65 becomes almost horizontal while being adjusted along the adjusting shaft 51 in a state where the filamentous material P is wound around the bobbin 72. Still further, it is assumed that, when the tension applied to the filamentous material P changes, the tension bar 65 swings due to an expansion or contraction of the coil spring 54.

First, by using a given weighing apparatus, the tension is measured while pulling the filamentous material P suspended in the groove 12A around the primary tension pulley 12 as shown in FIG. 5 from the side of the secondary tension pulley 66. In this case, when the weighing apparatus is pulled, the primary tension pulley 12 rotates and therefore the damping torque of the magnetic disks 20 and 20' is measured since, the magnetic disks rotate integrally with the primary tension pulley 12. The measured value is considered as a tension applied to the filamentous material P to be wound.

If the measured tension does not match an appropriate value of the tension to be applied to the filamentous material P, the tension is measured again after rotating the adjusting control 37A in a clockwise or counterclockwise direction. By repeating this operation several times, the tension to be applied to the filamentous material P is adjusted to an optimal value. After adjusting the tension to be applied to the filamentous material P to the optimal value, the adjusting bolt 37 is fixed by clamping the nut 38 to prevent a change of the tension value due to a rotation of the adjusting bolt 37 while the filamentous material is wound.

Subsequently, with operation of the winder 71, the filamentous material P is wound around the bobbin 72 after passing through the filament holding device 69, the guide pulley 70, a circumference (groove 12A) of the primary tension pulley 12, and the secondary tension pulley 66. When the filamentous material P is wound, the primary tension pulley 12 is rotated by the wound filamentous material. At this point, the primary tension pulley 12 is rotated without any slip of the filamentous material P due to the effect of the O-ring 36 mated with the groove 12A.

With the rotation of the primary tension pulley 12, both the magnetic disks 20 and 20', which are fixed integrally with the primary tension pulley 12, rotate and a given damping torque is generated by a plurality of the permanent magnets 28 acting on the magnetic disks 20 and 20'. It further applies a given tension (damping torque of the primary tension pulley) to the filamentous material P. Then, the filamentous material P is wound around the bobbin 72 through the secondary tension pulley 66 of the tension bar 65 with an appropriate tension applied by the primary tension pulley 12.

In this case, the damping torque of the primary tension pulley 12 is generated by causing a great magnetic action (damping torque) by means of a plurality of permanent magnets 28 having a plurality of magnetic poles and both the magnetic disks 20 and 20'. Therefore the magnetic disks 20 and 20' can be made smaller, and accordingly, since the magnetic disks 20 and 20' can be smaller the inertia of the primary tension pulley 12 becomes smaller, by which it becomes possible to rotate easily the primary tension pulley 12 at the start of the winding of the filamentous material P. Particularly for winding a filamentous material P having a thin diameter of the filament, it becomes possible to prevent the filamentous material P from breaking since the primary tension pulley 12 rotates easily.

Further, since the inertia of the magnetic disks 20 and 20' (the primary tension pulley 12) is low, rotation of the primary tension pulley 12 can be stopped immediately if winding is stopped for some reason while the filamentous material P is wound. Therefore, it becomes possible to prevent a disadvantage such that loose filamentous material P comes off of the primary tension pulley 12.

After the filamentous material P is wound up around the bobbin 72 of the winder 71 through the secondary tension pulley 66, the secondary tension pulley 66 is pulled downward, i.e. to the non-energized (lower) side, due to the tension of the wound filamentous material P. When the secondary tension pulley 66 is pulled down, the tension bar 65 swings downward and the adjusting shaft 51 is pushed up by the damper bearing 59 which is installed rotatably and integrally with the tension bar 65.

In this state, the tension bar 65 is biased horizontally into an almost static condition while being balanced between the tension with which the filamentous material P is wound and the biasing force of the coil spring 54 suspended from the adjusting shaft 51. An appropriate value is obtained for the tension applied to the filamentous material P in this state.

While the filamentous material P is wound, the tension of the filamentous material P may fluctuate for some reason. Particularly, if the filamentous material P is wound up around an oblong bobbin 72, the tension of the filamentous material P fluctuates periodically. Although the tension bar 65 also greatly swings, the swing of the damper bearing 59 is smaller due to the position of the damper bearing 59 arranged rotatably and integrally with the tension bar 65 so as to be located at almost one-fourth of the length of the adjusting shaft 51. Therefore, the swings of the adjusting shaft 51 are also smaller.

As a result, the expansion and contraction of the coil spring 54 of the present invention is almost one-fourth that of the spring in conventional apparatus and hence the operations of the adjusting shaft 51 and the tension bar 65 are stable. Therefore, the filamentous material P can be stably wound around the bobbin 72 and it is possible to reduce significantly the defective windings of the filamentous material P.

As described above, the permanent magnets 28 can move from the area of the inner circumference of of both the magnetic disks 20 and 20' in a radial direction toward the outer circumference thereof, and from the outer circumference to the area of the inner circumference. Therefore, the fine adjustment of the damping torque applied to the primary tension pulley 12 can be performed very easily.

In addition, great damping torque is generated by providing a plurality of magnetic poles in the ring-shaped permanent magnets 28 arranged near a plurality of the magnetic disks 20 and 20'. This makes it possible to apply great damping torque to the primary tension pulley 12, and hence the diameter of the magnetic disks 20 and 20' can be smaller.

Accordingly, the inertia of the primary tension pulley 12 can be reduced to an extremely low value. As a result, it is possible to prevent the filamentous material P from being broken by a delay of the rotation of the primary tension pulley 12 caused by its inertia at the start of the winding of the filamentous material P. In addition, it is possible to prevent the filamentous material P from being loosened and coming out of the groove 12A due to a delay in the stopping of the rotation of the primary tension pulley 12 caused by its inertia at the halting of the winding of the filamentous material P.

Although there are provided two magnetic disks rotating integrally with the primary tension pulley 12 in this embodiment, the present invention is not limited to it and one or three or more magnetic disks can be provided.

Further, although the magnet holders 26 and 26' are moved around the arm rotating shaft 29 in this embodiment, the present invention is not limited to it and the magnet holders 26 and 26' are able to be moved in a straight line ranging from inside to outside the circumferential of the magnetic disks.

Still further, although ring-shaped permanent magnets 28 are arranged on the magnetic holders in this embodiment, the present invention is not limited to this arrangement and an attraction force between the permanent magnets 28 and the magnetic disks can be enhanced by arranging an iron core at a given distance from the ring-shaped permanent magnets 28 inside the magnets.

Still further, although the damper bearing 59, which is set to rotate integrally with the tension bar 65, is located at about one-fourth of the length of the adjusting shaft 51, the present invention is not limited to this and the damper bearing 59 can be located at a shorter or longer distance than one-fourth the length of the adjusting shaft 51.

As described in detail in the above, the present invention comprises a magnetic disk rotating integrally with a primary tension pulley and permanent magnets arranged at a given distance from at least a surface of the magnetic disk, and includes a damping torque generation means for applying damping torque to the primary tension pulley and a stationary torque setting means for setting damping torque in a steady state by moving the permanent magnets in a radial direction of the magnetic disk, by which the damping torque applied to the primary tension pulley can be easily adjusted.

Accordingly, the tension applied to the filamentous material can be adjusted very easily with the tension control unit of the present invention and therefore this invention does not need a sensor nor a control unit like the conventional ones. As a result, it becomes possible to reduce greatly the cost of the tension control unit for filamentous material.

Further, this invention comprises a plurality of magnetic disks rotating integrally with the primary tension pulley and a plurality of permanent magnets arranged at a given distance from surfaces of the magnetic disks, and includes a damping torque generation means for applying damping torque to the primary tension pulley and a stationary torque setting means for setting damping torque in a steady state by moving the permanent magnets in a radial direction of the magnetic disks, by which the damping torque generated in a plurality of the magnetic disks can be easily adjusted according to the diameter of the filamentous material by means of the stationary torque setting means. Therefore, the damping torque applied to the primary tension pulley can be increased and the diameter of each magnetic disk can be decreased.

Still further, the inertia of the primary tension pulley can be reduced by decreasing the diameter of the magnetic disks and hence the primary tension pulley rotates easily at the start of the winding of the filamentous material. Accordingly, it becomes possible to prevent a delay of the rotation of the primary tension pulley at the start of the winding of the filamentous material and to prevent easily the filamentous material from being pulled and broken between the primary tension pulley and the winder due to the inertia of the pulley.

Furthermore, since the inertia of the primary tension pulley is low, it is possible to prevent the filamentous material from being loosen and from coming out of the groove of the primary tension pulley, even if the winding of the filamentous material is stopped suddenly.

Since a plurality of magnetic poles are arranged about the circumference of the ring-shaped permanent magnets, an attraction force of the permanent magnets can be greatly increased. Therefore, adjacent magnetic poles are attracted to each other through the magnetic disks and great damping torque can be generated, even if the diameter of each magnetic disk is decreased. As a result, it becomes possible to make magnetic disks having a smaller diameter than the conventional ones.

Further, the present invention comprises an adjusting shaft arranged so as to be free to rotate in the body in which the primary tension pulley is installed, a spring member installed in the adjusting shaft with one end fixed to the body and the other end free to move in a lengthwise direction of the adjusting shaft, and a damper that rotates interlocked with the tension bar and is sufficiently shorter than the adjusting shaft. A tip of the adjusting shaft is biased into contact with the damper, by which the tension bar is biased toward the side that causes the application of tension, by means of a spring force from the spring member. Therefore, it becomes possible to suppress the expansion and contraction of the coil spring to be extremely low, even if the tension bar swings greatly, since the spring member is adjusted at a long distance from the rotating shaft of the adjusting shaft.

Accordingly, even if the filamentous material is wound up with high-speed rotations using an oblong bobbin in the winding portion, the filamentous material can be stably wound up around the winding portion and it becomes possible to reduce defective windings of the filamentous material drastically.

While the foregoing and other features of the present invention have been described in the foregoing description of preferred embodiments, it should be understood by those skilled in the art that various changes can be made in the details without departing from the spirit and scope of the invention, which is limited only the appended claims.

What is claimed is:

1. A tension control unit for supplying filamentous material from a supply source to a coil winding portion by applying a given tension to it via a primary tension pulley to which damping torque is applied comprising:

a damping torque generation means for applying damping torque to said primary tension pulley which includes a plurality of magnetic disks which rotate integrally with said primary tension pulley and a plurality of permanent magnets arranged at a given distance from surfaces of each of the magnetic disks; and a stationary torque setting means for setting damping torque in a steady state by moving each of said permanent magnets in a radial direction of each of said magnetic disks.

2. A tension control unit according to claim 1, wherein each of said permanent magnets has a ring shape.

3. A tension control unit according to claim 2, wherein each of said permanent magnets has a plurality of magnetic poles on its circumference.

4. A tension control unit according to claim 1, further comprising:

a secondary tension pulley arranged at a swinging end of a tension bar biased in a direction to apply tension;

an adjusting shaft arranged to rotate freely in a body in which the primary tension pulley is installed;

a spring member attached to the adjusting shaft with one end fixed to said body and the other end free to move in a lengthwise direction of said adjusting shaft; and a damper which rotates while being interlocked with the tension bar and which is fully shorter than said adjusting shaft, said tension bar being biased in a direction to apply tension by means of a spring force of said spring member, a tip of said adjusting shaft being biased into contact with said damper.

5. A tension control unit according to claim 4 wherein each of said permanent magnets has a ring shape.

6. A tension control unit according to claim 5 wherein each of said permanent magnets has a plurality of magnetic poles on its circumference.

7. A tension control unit for supplying filamentous material from a supply source to a coil winding portion by applying a given tension to it via a primary tension pulley to which damping torque is applied, the tension control unit comprising:

a damping torque generation means for applying damping torque to said primary tension pulley which includes a magnetic disk which rotates integrally with said primary tension pulley and a frame on which plurality of permanent magnets are arranged to be at a given distance from a surface of the magnetic disk; and a torque setting means for setting damping torque in a steady state by moving said permanent magnets on said frame in a radial direction of said magnetic disk to bring each of said plurality of permanent magnets sequentially into magnetic interaction with said magnetic disk.

8. A tension control unit as in claim 7 wherein said plurality of permanent magnets are arranged on said frame along part of a circle.

9. A tension-control unit as in claim 8 wherein the radial direction of movement of said plurality of magnets follows an arcuate line.

10. A tension-control unit as in claim 7 wherein the radial direction of movement of said plurality of magnets follows an arcuate line.

* * * * *